US008106832B2

(12) United States Patent
De Vita

(10) Patent No.: US 8,106,832 B2
(45) Date of Patent: Jan. 31, 2012

(54) CIRCULARLY POLARIZED PATCH ANTENNA WITH SINGLE SUPPLY POINT

(75) Inventor: Placido De Vita, Aci Catena (IT)

(73) Assignee: STMicroelectronics S.r.l., Agrate Brianza (MI) (IT)

( * ) Notice: Subject to any disclaimer, the term of this patent is extended or adjusted under 35 U.S.C. 154(b) by 378 days.

(21) Appl. No.: 12/402,844

(22) Filed: Mar. 12, 2009

(65) Prior Publication Data

US 2009/0231207 A1 Sep. 17, 2009

(30) Foreign Application Priority Data

Mar. 13, 2008 (IT) ..... TO2008A0192

(51) Int. Cl.
*H01Q 1/38* (2006.01)

(52) U.S. Cl. ..... 343/700 MS; 343/846

(58) Field of Classification Search ..... 343/700 MS, 343/846, 850, 859
See application file for complete search history.

(56) References Cited

U.S. PATENT DOCUMENTS

| | | | | |
|---|---|---|---|---|
| 5,371,507 | A * | 12/1994 | Kuroda et al. | 343/700 MS |
| 6,326,923 | B2 | 12/2001 | Shigihara | |
| 6,774,866 | B2 * | 8/2004 | McKinzie et al. | 343/909 |
| 7,221,321 | B2 * | 5/2007 | Reuss | 343/700 MS |
| 7,382,322 | B1 * | 6/2008 | Yang et al. | 343/700 MS |
| 7,605,758 | B2 * | 10/2009 | Lazar | 343/700 MS |
| 2003/0063031 | A1 | 4/2003 | Wong et al. | |
| 2007/0285256 | A1 * | 12/2007 | Batra | 340/572.8 |

* cited by examiner

*Primary Examiner* — Hoanganh Le
(74) *Attorney, Agent, or Firm* — Lisa K. Jorgenson; James H. Morris; Wolf, Greenfield & Sacks, P.C.

(57) ABSTRACT

An antenna for circularly polarized radiation having a lamina of electrically conductive material with a generally square shape and a first chamfer on a first vertex of the generally square shape. The chamfer determines an asymmetrical shape of the lamina.

23 Claims, 7 Drawing Sheets

CIRCULARLY POLARIZED PATCH ANTENNA WITH SINGLE SUPPLY POINT

CROSS REFERENCE TO RELATED APPLICATIONS

This application claims the priority benefit of Italian patent application number TO2008A 000192, filed on Mar. 13, 2008, entitled "CIRCULARLY POLARIZED PATCH ANTENNA WITH SINGLE SUPPLY POINT," which is hereby incorporated by reference to the maximum extent allowable by law.

BACKGROUND OF THE INVENTION

1. Field of the Invention

The present invention relates to a circularly polarized patch antenna, and in particular to a circularly polarized patch antenna with single supply point.

2. Discussion of the Related Art

As is known, patch antennas are widely employed in applications that require use of antennas, characterized by small overall dimensions, planar geometry, and constructional simplicity.

In particular, the patch antennas widely available on the market comprise a ground surface and a metal lamina arranged parallel above the ground surface with an interposed dielectric layer; the thickness of the metal lamina is negligible as compared to the thickness of the dielectric layer so that the metal lamina can be generally equated to a two-dimensional object, identifying a plane. A protective casing, typically of plastics, may be arranged around the ground surface and the metal lamina so as to guarantee a protection from atmospheric agents.

The metal lamina represents the radiant component of the patch antenna and is generally supplied by a supply line, that carries signals directed to the metal lamina or coming from the metal lamina. Generally, the supply line comprises a stripline connected to the metal lamina, or a metal via arranged in the dielectric layer orthogonal to the ground surface and to the metal lamina. In the case of a metal via, a connector is generally arranged at one end of the metal via, while the other end is connected to the metal lamina, thereby enabling ohmic contact between the metal lamina and a possible external connection cable coupled to the connector. Typically, the point of contact between the metal via and the metal lamina is chosen so that the impedance represented by the metal lamina and seen by the metal via is approximately equal to 50Ω.

Given an operating wavelength, a patch antenna having a particularly simple geometry comprises a metal lamina of a rectangular shape, wherein a first side, typically the long side, is slightly shorter than half of the operating wavelength, to take into account any non-ideality of distribution of the field on the edges (the so-called "fringing field"). The supply is provided by a stripline connected to a second side of the metal lamina, orthogonal to the first side. The patch antenna with the geometry described irradiates linearly polarized radiation, with an antenna efficiency that depends, among other factors, upon the impedance seen from the supply line, i.e., from the stripline, towards the metal lamina, in particular upon the impedance adaptation between the stripline and the metal lamina. As is known, the metal lamina is sized at a design frequency, generally equal to the nominal operating frequency of the patch antenna, while the supply line is designed to optimize impedance adaptation between the supply line and the metal lamina. Moving away from the design frequency, the levels of performance of the patch antenna decay rapidly.

According to the type of supply line, commonly known patch antennas can be classified into:

patch antennas with two supply points, an illustrative example whereof is shown in FIG. 1, typically supplied by two stripline 50 traversed by respective supply signals;

patch antennas with a single supply point, an illustrative example whereof is shown in FIG. 2, wherein the supply line comprises a metal via 51 extending in the dielectric layer perpendicular to the ground surface and to the metal lamina; and patch antennas with a single supply point in the plane defined by the metal lamina, as shown in the illustrative examples of FIGS. 3*a*-3*c*, wherein the supply line comprises a stripline 52 parallel to the ground surface and lying in the plane defined by the metal lamina.

As regards the polarization of the radiation emitted by the patch antenna, and bearing in mind the classification corresponding to the type of supply, patch antennas are available having geometries that enable irradiation and reception of circularly polarized radiation, said antennas being also known as circularly polarized patch antennas. These patch antennas find wide application in systems that make use of circularly polarized radiation, such as, for example, systems for satellite communications or else systems for automated payment of roadway tolls.

The circular polarization is obtained by using metal laminas provided with portions without metal arranged in a symmetrical way inside the metal lamina; otherwise, there would be the risk of receiving just a part of the circularly polarized radiation.

Circularly polarized patch antennas are also known, comprising a rectangular metal lamina, the lengths of the sides whereof respect a given ratio. Generally, patch antennas of this type have a single supply point and use a metal via.

Further circularly polarized patch antennas comprise a square metal lamina and two supply points, in addition to supply lines provided with power dividers and phase-shifters.

To avoid the use of two supply lines, albeit maintaining the circular polarization, circularly polarized patch antennas have been introduced comprising a lamina having a square shape chamfered at the vertices. In particular, use is known of a square metal lamina provided with two equal chamfers arranged on two opposite vertices of the square identified by the metal lamina, i.e., arranged in a symmetrical way with respect to a diagonal of the metal lamina, as illustrated in FIGS. 3*a* and 3*b*. The presence of the chamfers enables degeneration of the orthogonal modes of the antenna and, consequently, emission/reception of circularly polarized radiation.

As illustrated once again in FIGS. 3*a* and 3*b*, circularly polarized patch antennas comprising a lamina having the shape of a square chamfered at the vertices typically have a single supply point in the plane defined by the metal lamina; the supply is provided by a stripline line. Given this particular supply line, the geometry of the metal lamina is usually designed not only on the basis of an optimization of the polarization of the irradiated/received radiation, but also on the basis of the impedance adaptation between the supply stripline line and the metal lamina. As illustrated in FIGS. 3*a*-3*c*, very sophisticated geometries of the metal lamina are employed, comprising recesses at the edges of the perimeter of the metal lamina, housing part of the stripline line, so that the stripline line is ohmically connected to the metal lamina not at one of the sides of the lamina, but rather inside the aforementioned perimeter. In greater detail, the point of connection between the metal lamina and the supply line is designed so as to optimize the impedance adaptation between the metal lamina and the stripline supply line. Since stripline lines are generally sized so as to have a characteristic impedance of approximately 50Ω, the point of connection is designed so that the impedance represented by the metal lamina seen by the stripline line from the point of connection is approximately 50Ω. To enable a better adaptation, metal laminas are known that have, in addition to the recess housing the stripline line, further recesses housing metal stubs, as illustrated in FIGS. 3*b* and 3*c*.

Known circularly polarized patch antennas are not free from disadvantages. In particular, circularly polarized patch antennas with two supply points generally require the use of power dividers/adders and of 90-degree phase-shifters, i.e., additional elements that are costly as compared to the patch antenna. Sizing of these additional components is frequently problematical, since both the power dividers/adders and the phase-shifters generally have dimensions comparable with the dimensions of the metal lamina and can cause perturbation in the irradiation diagram of the patch antenna.

Furthermore, circularly polarized patch antennas with a single supply point that use a metal via, albeit not requiring additional components, frequently present higher production costs, since the provision of the metal via inside the dielectric layer can entail greater structural complexity.

As regards circularly polarized patch antennas with a single supply point in the plane defined by the metal lamina, they are difficult to implement at high frequency, since to have impedance adaptation between the stripline line and the metal lamina, and in particular to have a stripline line with a characteristic impedance of 50Ω, it would be necessary to use a metal lamina of the patch antenna having a width comparable with the dimensions of the stripline line.

SUMMARY OF THE INVENTION

One aim of the present invention is to provide a circularly polarized patch antenna with single supply point that solves at least in part the drawbacks of the known art.

According to an embodiment of the present invention, a circularly polarized patch antenna with a single supply point comprises an antenna for circularly polarized radiation comprising a lamina of electrically conductive material with a generally square shape having a first chamfer on a first vertex of said generally square shape, wherein said first chamfer gives an asymmetrical shape to said lamina.

According to an embodiment of the present invention, there is provided a communication system for data transmission between a querying unit and a queried unit, said querying unit comprising a querying antenna, wherein said on-board unit comprises a transmitting patch antenna and a receiving patch antenna, each formed by an antenna.

BRIEF DESCRIPTION OF THE DRAWINGS

For a better understanding of the invention, embodiments thereof are now described, purely by way of non-limiting example and with reference to the attached drawings, wherein.

DETAILED DESCRIPTION

Figure 1:
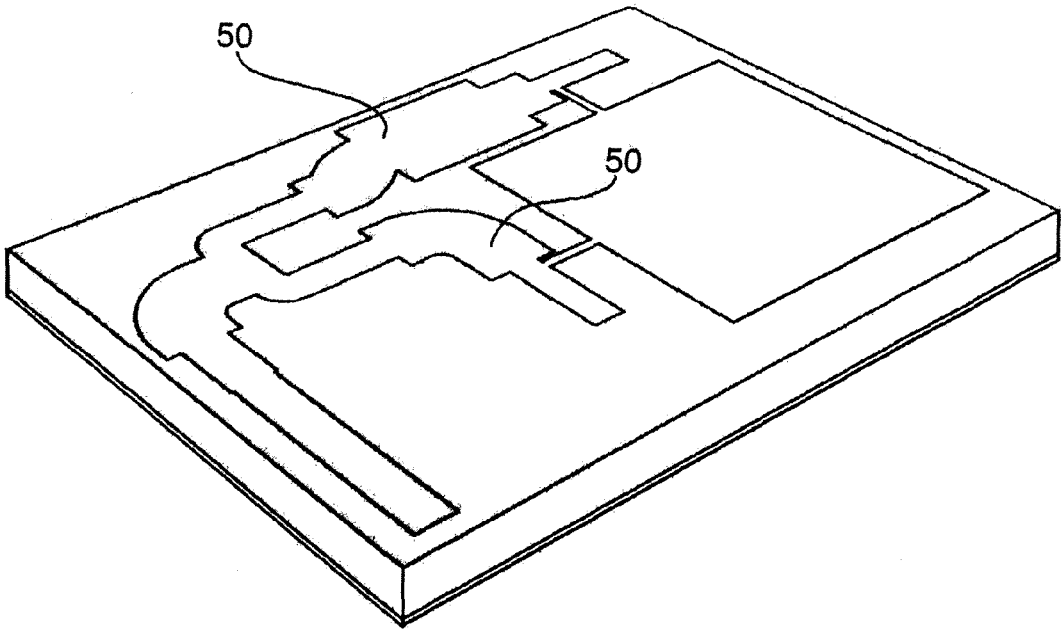
FIG. 1 PRIOR ART
FIG. 1 is a top view of a circularly polarized patch antenna with two supply points.
Figure 2:
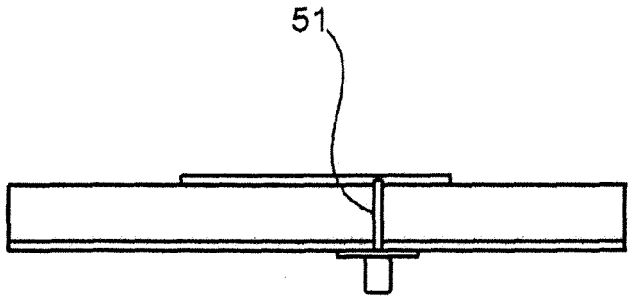
FIG. 2 PRIOR ART
FIG. 2 shows a side view of a circularly polarized patch antenna with single supply point.
Figure 3A:
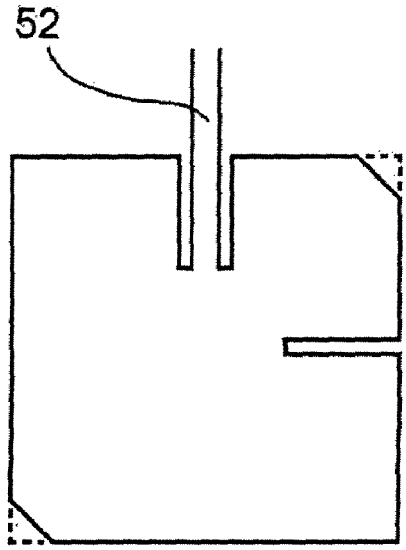
FIG. 3a PRIOR ART
FIGS. 3*a*-3*c* are top views of circularly polarized patch antennas with single supply points in the plane defined by the metal lamina.
Figure 3B:
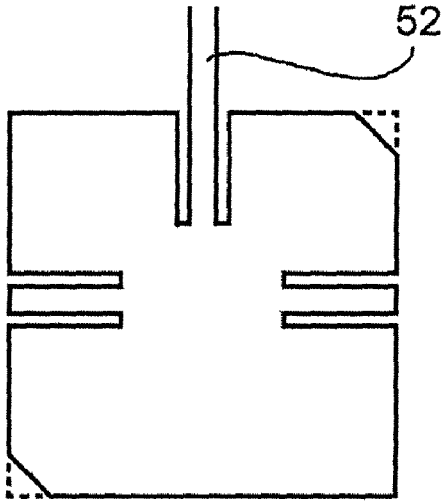
FIG. 3b PRIOR ART
Figure 3C:
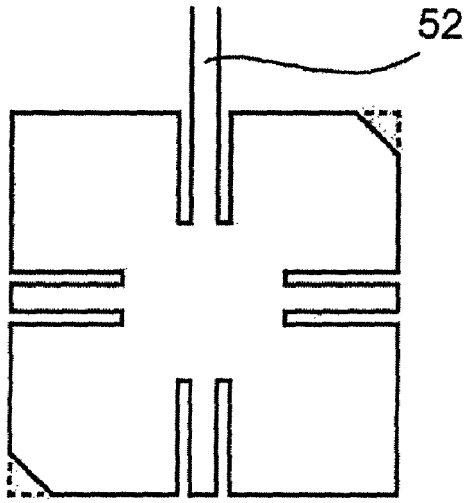
FIG. 3c PRIOR ART
Figure 4:
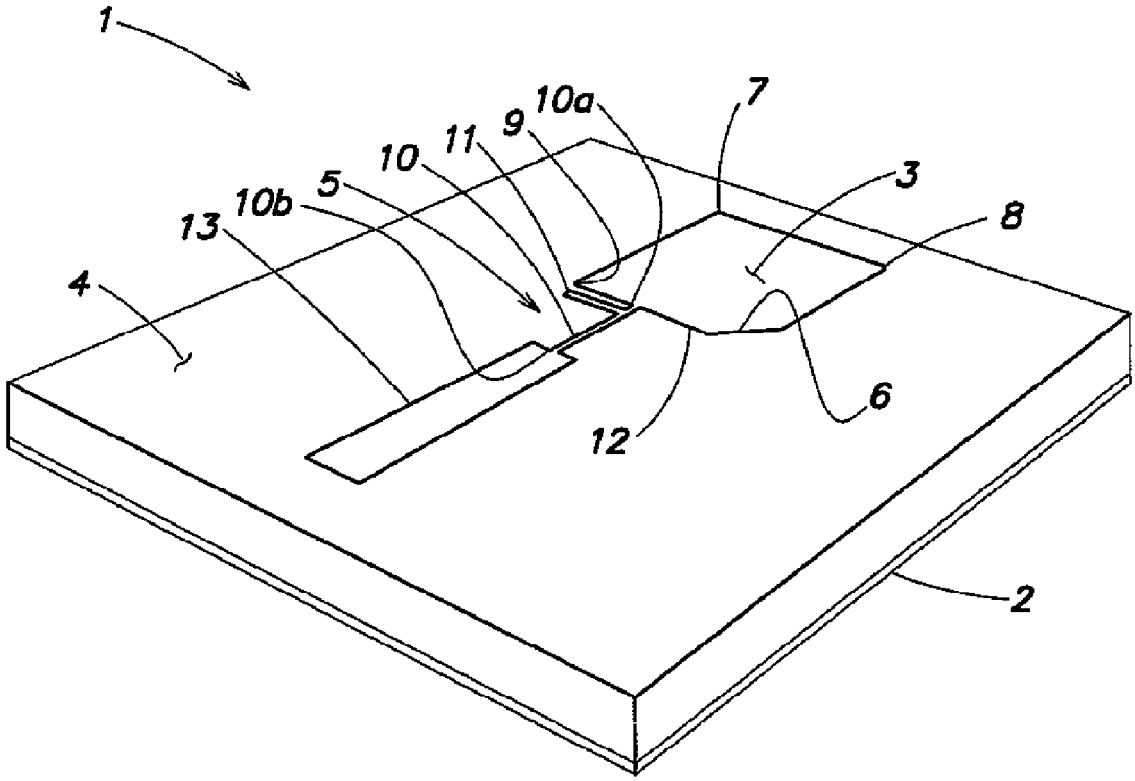
FIG. 4 is a top view of a patch antenna according to one embodiment of the present invention.

FIG. 4 is a schematic illustration of a patch antenna 1, and more precisely a circularly polarized patch antenna with a single supply point. The patch antenna 1 comprises a ground surface 2, a metal lamina 3, arranged above the ground surface 2, and a dielectric material layer 4, arranged between the ground surface 2 and the metal lamina 3. The patch antenna 1 further comprises an adaptation line 5 configured for performing impedance adaptation between the antenna and the outside world, as well as functioning as a supply line of the patch antenna 1, i.e., being traversed by electromagnetic signals directed towards the metal lamina 3 or coming from the metal lamina 3.

The metal lamina 3 has a generally square shape. In greater detail, the metal lamina 3 comprises a metal layer having a negligible thickness and a square shape, as well as a first, a second, a third, and a fourth chamfers 6-9, at the vertices whereof. As is shown in greater detail in FIG. 5, the chamfers 6-9 are rectilinear and inclined at 45° with respect to the corresponding sides of the square defined by the metal lamina 3. Consequently, the chamfers 6-9 are parallel to the diagonals of the metal lamina 3.

Figure 5:
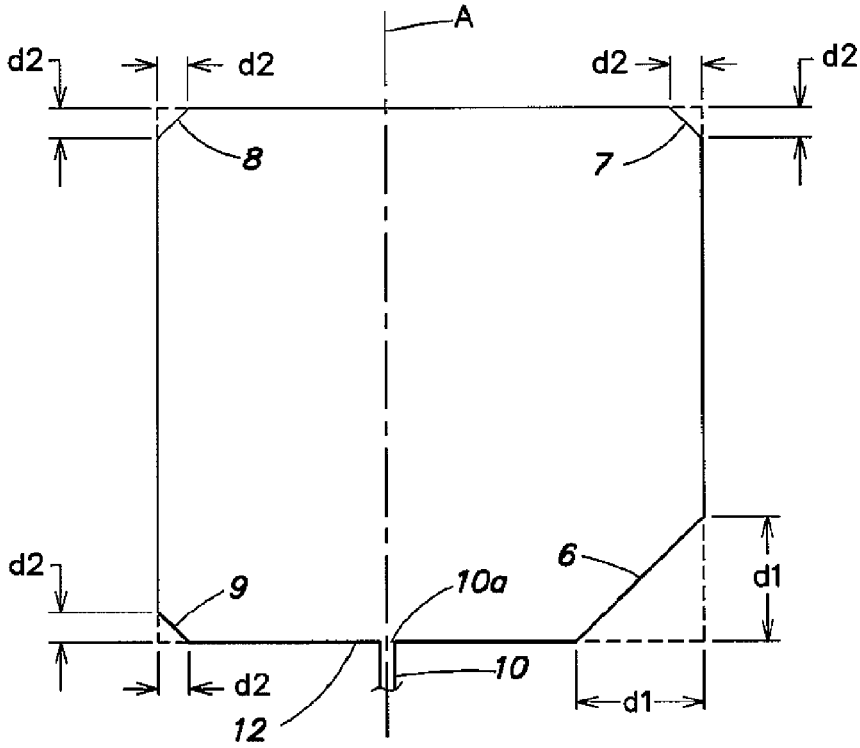
FIG. 5 shows a detail of the patch antenna of FIG. 4.

In the case shown in FIG. 5, the first chamfer 6 has a greater length than the other chamfers 7-9.

The adaptation line 5 comprises a stripline line 10, a stub 11, and a path 13. The stripline line 10 has a first end 10*a* connected to one side 12 of the metal lamina 3. The stub 11 is arranged perpendicular to the stripline line 10 and connected thereto at an intermediate point of the stripline line 10. The path 13, which has a characteristic impedance preferably around 50Ω, is connected to a second end 10*b* of the stripline line 10 and has the function of connecting the patch antenna 1 with the outside world. The connection point between the stripline line 10 and the side of the metal lamina 3, as the connection point between the stub 11 and the stripline line 10, are such as to optimize the impedance adaptation between the metal lamina 3 and the adaptation line 5.

In the case shown in FIG. 5, where, in top view, the first chamfer 6, of greater length, is arranged on the right of an axis A perpendicular to the side 12, the radiation emitted by the metal lamina 3 has a left circular polarization. In a different embodiment, not shown, the first chamfer 6 can be arranged on the left, in top view, of the axis A, and in this case the radiation emitted by the metal lamina 3 would have a right circular polarization.

In one embodiment, the dielectric material layer is of FR4 ITEQ 155G.

Figure 6:
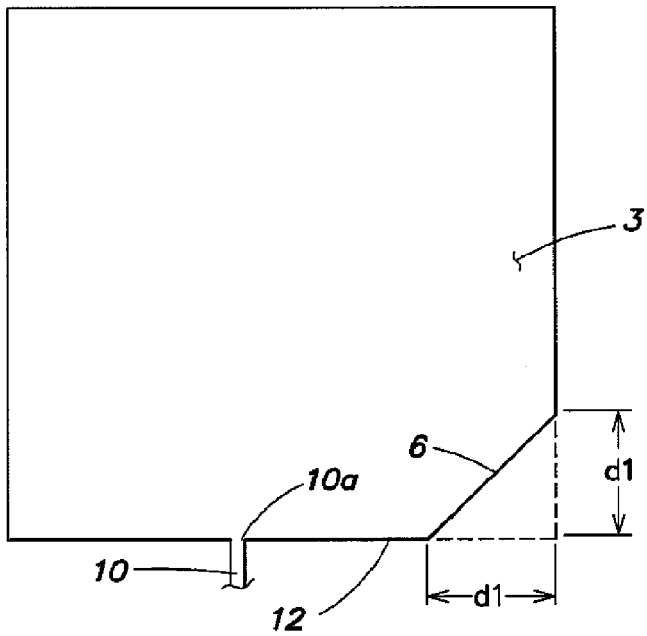
FIG. 6 is a top view of the present patch antenna according to a different embodiment.

FIG. 6 shows a further embodiment wherein the metal lamina 3, once again of a square shape, has just one chamfer 6 at one of its vertices. Also in this case, the chamfer 6 is rectilinear and parallel to a diagonal of the metal lamina 3.

In the patch antenna 1 described, the degeneration of the orthogonal modes is achieved by using a square metal lamina 3 provided with chamfers arranged in an asymmetrical way, even just one chamfer. In particular, in the case of four chamfers, illustrated in FIG. 5, the asymmetry is obtained due to the fact that the first chamfer 6 and the second chamfer 7, which are diagonally opposite, have different dimensions. In this particular embodiment, the use of a third chamfer 8 and a fourth chamfer 9, which are diagonally opposite and the same as one another, has the effect of increasing the bandwidth in which the antenna can operate.

Given the geometry of the metal lamina 3 just described, the adaptation line 5 enables the desired impedance to be obtained at the second end 10*b* of the stripline line 10, without the need to make further recesses or slits in the metal lamina 3 and hence with a greater constructional simplicity.

Figure 7:
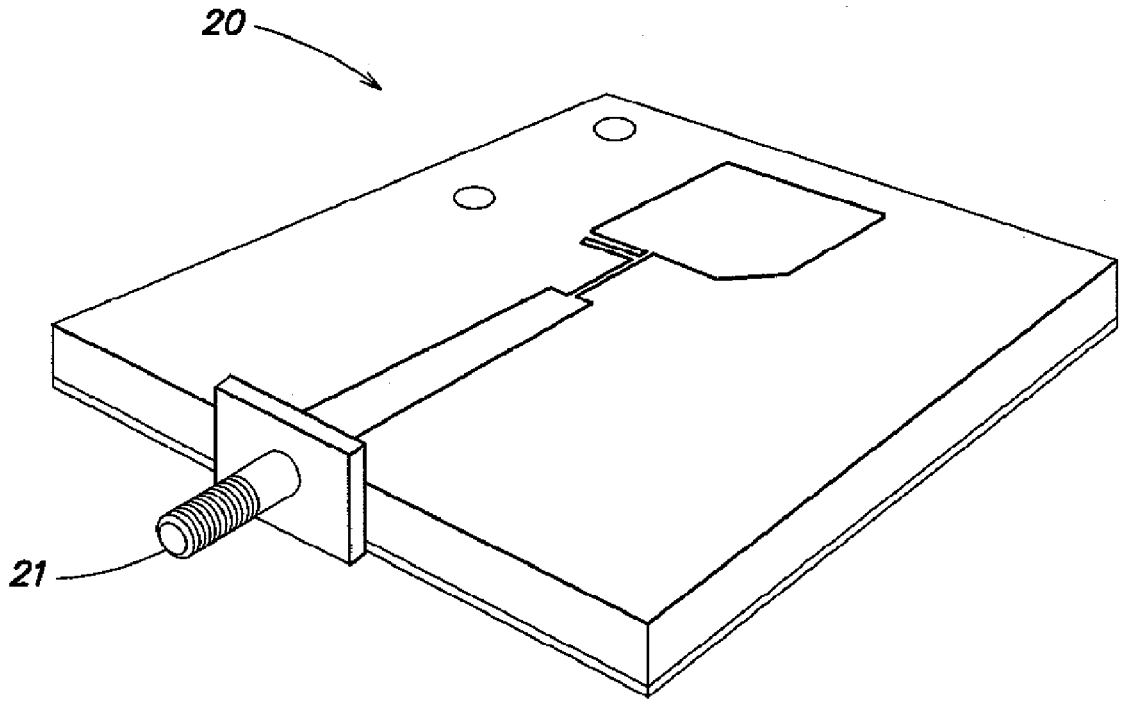
FIG. 7 shows an electronic card comprising the present patch antenna.

As illustrated in FIG. 7, the present antenna can advantageously be integrated in an electronic card 20, moreover comprising a connector 21 of the SMA (SubMiniature version A) type, designed to enable routing of electromagnetic signals from and to the outside world.

Figure 8:
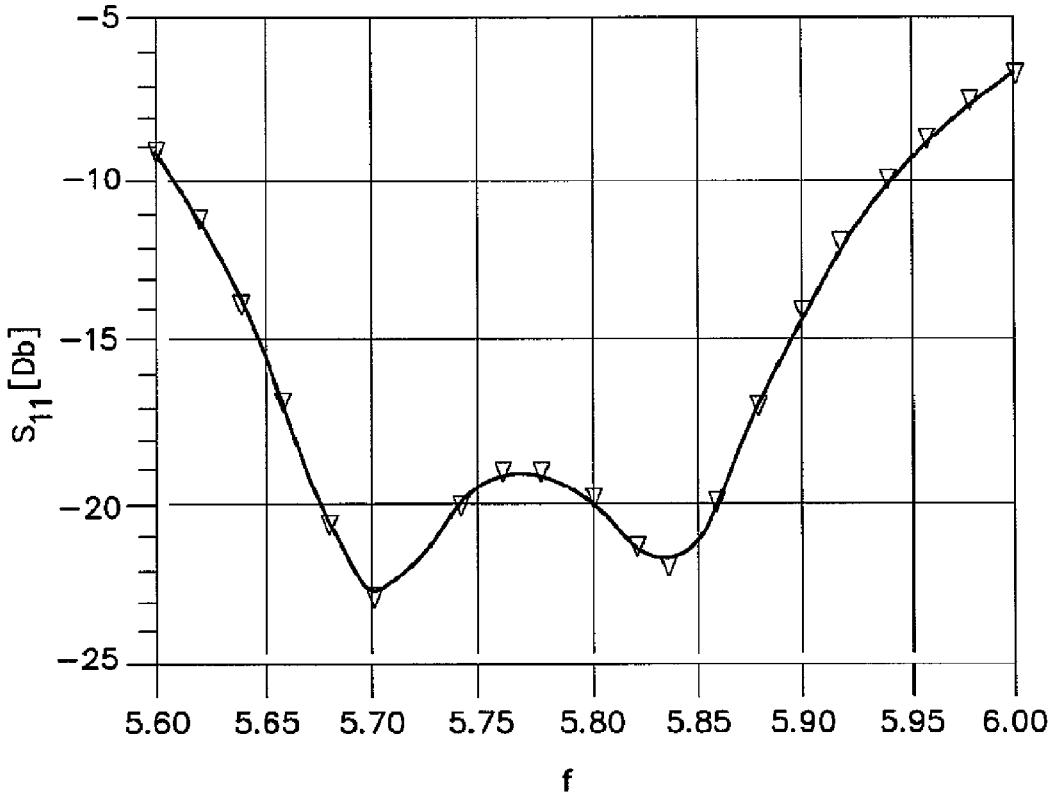
FIG. 8 shows the magnitude of the return-loss coefficient $S_{11}$ of one embodiment of the present invention versus the frequency.

At the experimental level, the patch antenna described has an impedance adaptation that is satisfactory over a bandwidth in the range of 300 MHz, as may be implicitly inferred from the plot shown in FIG. 8, which illustrates the magnitude of the return-loss coefficient $S_{11}$, i.e., the ratio between the power reflected by the antenna and the power supplied to the antenna, versus the frequency f. In addition, the present antenna has a gain of around 5 dB and a rejection of the opposite circular polarization around 30 dB, with an antenna efficiency of approximately 66%.

Figure 9:
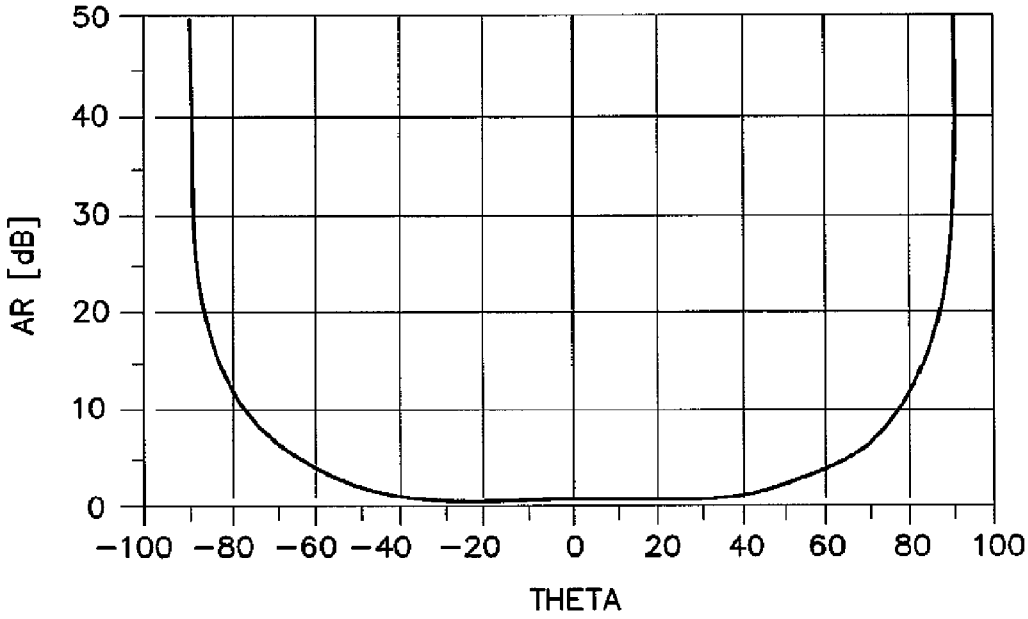
FIG. 9 shows the modulus of the axial ratio of circular polarization AR of one embodiment of the present invention versus the emission angle THETA.

As regards the polarization of the emitted radiation, FIG. 9 illustrates the modulus of the axial ratio of circular polarization AR versus the emission angle THETA in a plane perpendicular to the stripline line 10, highlighting how the present antenna has an axial ratio of circular polarization AR approximately equal to a unity, i.e., an excellent circular polarization, in a wide range of values of the emission angle THETA.

Thanks to its performance, the present patch antenna 1 is advantageously applicable in communication systems that make use of circular polarization radiation such as, for example, communication systems used in systems for automatic payment of highway tolls.

Figure 10:
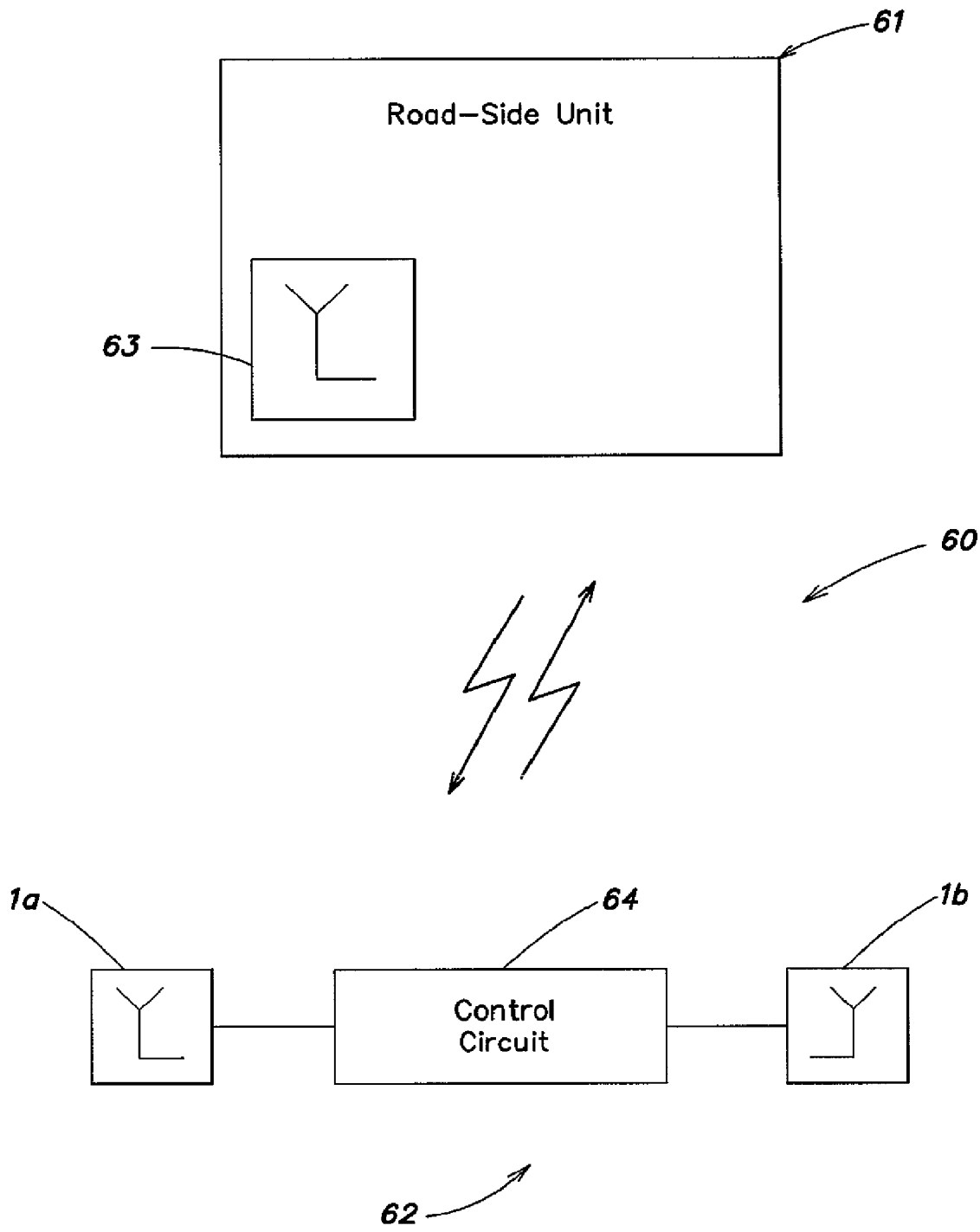
FIG. 10 shows a block diagram of a system using the present patch antenna.

Automatic-payment systems are based upon exchange of data between the motor vehicle and the highway toll-gate, the exchange of data being entrusted to the aforementioned communication systems, which transmit electromagnetic signals modulated with the data. In particular, as shown in FIG. 10, a communication system of the type used in the systems for automatic payment of the toll, designated by 60, comprises a road-side unit (RSU) 61, arranged in the proximity of entrances to motorway toll-gates, and a plurality of on-board units (OBU) 62, one of which is shown in FIG. 10, arranged on respective motor vehicles. The road-side unit 61 comprises an antenna 63 of a known type, while the on-board unit 62 comprises a transmitting patch antenna 1*a* and a receiving patch antenna 1*b*, both of the previously described type. The transmitting patch antenna 1*a* and the receiving patch antenna 1*b* are electrically connected via an electronic control circuit 64.

In the example considered, the road-side unit 61 transmits periodically, through its own antenna 63, a sequence of a wake-up signal and a non-modulated signal (pure tone). The wake-up signal comprises a circularly polarized electromagnetic radiation modulated with wake-up data. The non-modulated signal comprises a non-modulated circularly polarized electromagnetic radiation (continuous wave CW).

When the electronic control circuit 64, via the receiving patch antenna 1*b*, receives the wake-up signal, it exits from a stand-by condition and, upon receiving the next non-modulated signal, generates, starting from this, a back-diffused electromagnetic radiation, directed towards the road-side unit 61 and modulated with the data of the on-board unit 62.

In particular, in the example shown, the electronic control circuit 64 comprises a modulator (not shown in FIG. 10), which modulates the non-modulated signal with the data to be transmitted. The electrical signal resulting from this modulation is supplied to the transmitting patch antenna 1*a*, which generates a corresponding electromagnetic radiation directed towards the road-side unit 61.

The described communication system 60 works in half-duplex mode, i.e., in an alternately unidirectional mode, and envisages transmission of data in packets or frames.

With reference to FIG. 5, in the case of automatic-payment systems, the metal lamina 3 has a side of 0.94 cm (370 mils). In addition, for the first chamfer 6, the distances between the ends and the vertices of the chamfer d1 are 0.25 cm (98 mils), while for the second, third and fourth chamfers 7-9, the distances d2 are 0.023 cm (9 mils). In practice, the first chamfer 6 has a length of approximately 0.35 cm, while the second, third and fourth chamfers 7-9 have a length of approximately 0.032 cm.

Furthermore, the stripline line 10 has a characteristic impedance of 127Ω and a length of 0.65 cm (256 mils), with a stub of the same impedance of 127Ω and a length of 0.39 cm (155 mils), so that the impedance seen from the second end 10*b* of the stripline line 10 towards the metal lamina 3 is approximately equal to 50Ω at the design frequency of the antenna (5.8 GHz), i.e., equal to the characteristic impedance of the path 13. Given the impedance adaptation at 50Ω of the adaptation line 5, the path 13 has the function of mere path adapted for the electromagnetic signals received by the patch antenna or else transmitted by the patch antenna.

Consequently, the patch antenna 1 has a high gain and a good impedance adaptation at 50Ω at the operating frequencies of the above communication systems, which is generally 5.8 GHz.

Finally, it is evident that modifications and variations may be made to the described patch antenna, without thereby departing from the scope of the present invention, defined by the annexed claims.

In particular, the shape, dimensions, and arrangement of the chamfers of the metal lamina can vary with respect to what has been illustrated, provided that their arrangement is asymmetrical. For example, it is possible to provide just two chamfers of different dimensions, arranged on opposite sides with respect to the axis A.

Furthermore, the shape of the chamfers and their inclination with respect to the adjacent sides of the lamina can vary slightly with respect to what has been illustrated.

Having thus described at least one illustrative embodiment of the invention, various alterations, modifications, and improvements will readily occur to those skilled in the art. Such alterations, modifications, and improvements are intended to be within the spirit and scope of the invention. Accordingly, the foregoing description is by way of example only and is not intended as limiting. The invention is limited only as defined in the following claims and the equivalents thereto.

What is claimed is:

1. An antenna for circularly polarized radiation comprising a lamina of electrically conductive material with a generally square shape having a first chamfer on a first vertex of said generally square shape, wherein said first chamfer gives an asymmetrical shape to said lamina, and wherein said lamina of electrically conductive material further has a second chamfer arranged at a second vertex diagonally opposite to said first chamfer, said second chamfer having different dimensions from said first chamfer.

2. The antenna according to claim 1, further comprising a supply line connected to a side of said lamina, wherein an axis transverse with respect to said side divides said lamina into lamina portions and said first chamfer is arranged in a first lamina portion so that said antenna emits circularly polarized radiation with a first rotation direction when said first lamina portion is to the right of said axis in top view and emits circularly polarized radiation with a second rotation direction when said first portion is to the left of said axis.

3. The antenna according to claim 1, wherein said first chamfer has a greater length than said second chamfer.

4. The antenna according to claim 1, further comprising a third and a fourth chamfer arranged, respectively, on a third and a fourth vertex, both contiguous to said first vertex, of said generally square shape.

5. The antenna according to claim 4, wherein said third and fourth chamfer have a smaller length than said first chamfer.

6. The antenna according to claim 4, wherein said third and said fourth chamfer have a length equal to said second chamfer.

7. The antenna according to claim 1, comprising an adaptation line including:

a stripline line, a first end whereof is connected to the metal lamina at one of the sides of said generally square shape; and a stub, connected at an intermediate point of said stripline line.

8. The antenna according to claim 4, wherein said first, second, third, and fourth chamfers extend at approximately 45° with respect to the sides of said generally square shape.

9. The antenna according to claim 4, wherein said generally square shape has a side of 0.94 cm (370 mils), said first chamfer has a length of 0.35 cm, while the second, the third and the fourth chamfers have lengths of 0.032 cm.

10. A communication system for data transmission between a querying unit and a queried unit, said querying unit comprising a querying antenna, wherein said querying antenna comprises a transmitting patch antenna and a receiving patch antenna, each formed by an antenna for circularly polarized radiation comprising a lamina of electrically conductive material with a generally square shape having a first chamfer on a first vertex of said generally square shape, wherein said first chamfer gives an asymmetrical shape to said lamina, and wherein said lamina of electrically conductive material further has a second chamfer arranged at a second vertex diagonally opposite to said first chamfer, said second chamfer having different dimensions from said first chamfer.

11. The communication system according to claim 10, wherein:

said querying unit is configured for emitting, in sequence, a modulated wake-up signal and a non-modulated tone signal;

said queried unit is configured so as to exit from a stand-by condition upon reception of said wake-up signal, to generate a back-diffused signal obtained by modulating said non-modulated tone signal with data identifying said queried unit, and to transmit said back-diffused signal to said querying unit.

12. The communication system according to claim 10, forming an automatic toll-paying system, wherein said querying unit is arranged in the proximity of a roadway toll-gate and said queried unit is arranged on a motor vehicle.

13. The antenna according to claim 10, further comprising a third and a fourth chamfer arranged, respectively, on a third and a fourth vertex, both contiguous to said first vertex, of said generally square shape.

14. The antenna according to claim 13, wherein said third and fourth chamfer have a smaller length than said first chamfer.

15. An antenna for circularly polarized radiation, comprising:

a dielectric material layer; and a metal lamina of electrically conductive material on the dielectric material layer, the metal lamina having a generally square shape and having first and second chamfers at first and second diagonally opposite vertices of the generally square shape, wherein the first chamfer has a greater length than the second chamfer.

16. An antenna as defined in claim 15, further comprising third and fourth chamfers arranged, respectively, on third and fourth vertices of the generally square shape.

17. An antenna as defined in claim 16, wherein said third and fourth chamfers have a smaller length than the first chamfer.

18. An antenna as defined in claim 16, wherein the third and fourth chamfers have a length equal to the second chamfer.

19. An antenna as defined in claim 16, wherein the first, second, third and fourth chamfers extend at approximately 45 degrees with respect to the sides of the generally square shape.

20. A querying unit or data transmission between the querying unit and a queried unit, comprising:

a transmitting patch antenna and a receiving patch antenna, each patch antenna configured for circularly polarized radiation and comprising a metal lamina of electrically conductive material on a dielectric material layer, the metal lamina having a generally square shape and having first and second chamfers at first and second diagonally opposite vertices of the generally square shape, wherein the first chamfer has a greater length than the second chamfer.

21. A querying unit as defined in claim 20, wherein the transmitting patch antenna and the receiving patch antenna each further comprise third and fourth chamfers arranged, respectively, on third and fourth vertices of the generally square shape.

22. A querying unit as defined in claim 21, wherein the third and fourth chamfers have a smaller length than the first chamfer.

23. A querying unit as defined in claim 21, wherein the third and fourth chamfers have a length equal to the second chamfer.

* * * * *